US010190447B2

(12) United States Patent
Brenner

(10) Patent No.: US 10,190,447 B2
(45) Date of Patent: Jan. 29, 2019

(54) CAMSHAFT ADJUSTER AND SEPARATING SLEEVE FOR A CAMSHAFT ADJUSTER

(71) Applicant: SCHAEFFLER TECHNOLOGIES GMBH & CO. KG, Herzogenaurach (DE)

(72) Inventor: Holger Brenner, Obermichelbach (DE)

(73) Assignee: SCHAEFFLER TECHNOLOGIES GMBH & CO. KG, Herzogenaurach (DE)

( * ) Notice: Subject to any disclaimer, the term of this patent is extended or adjusted under 35 U.S.C. 154(b) by 968 days.

(21) Appl. No.: 14/388,490

(22) PCT Filed: Mar. 26, 2013

(86) PCT No.: PCT/EP2013/056331
§ 371 (c)(1),
(2) Date: Sep. 26, 2014

(87) PCT Pub. No.: WO2013/167311
PCT Pub. Date: Nov. 14, 2013

(65) Prior Publication Data

US 2015/0059519 A1 Mar. 5, 2015

(30) Foreign Application Priority Data

May 7, 2012 (DE) ..... 10 2012 207 477

(51) Int. Cl.
*F01L 1/34* (2006.01)
*F01L 1/344* (2006.01)

(52) U.S. Cl.
CPC ..... *F01L 1/3442* (2013.01); *Y10T 74/2102* (2015.01)

(58) Field of Classification Search
CPC ..... F01L 1/3442; F01L 2001/34433; F16C 33/107; F16C 17/026
See application file for complete search history.

(56) References Cited

U.S. PATENT DOCUMENTS 2,625,448 A * 1/1953 Underwood ..... F16C 17/026 184/6.5
6,089,361 A * 7/2000 Davison ..... F16D 51/22 188/206 R (Continued)

FOREIGN PATENT DOCUMENTS

DE 10 2008 011 116 8/2009
DE 10 2008 029 692 1/2010

(Continued)

*Primary Examiner* — Thomas C Diaz
(74) *Attorney, Agent, or Firm* — Davidson, Davidson & Kappel, LLC

(57) ABSTRACT

A camshaft adjuster has a stator, a rotor rotatable relative to the stator with a hub for receiving a camshaft. First supply ducts and second supply ducts penetrate the hub radially, and a separating sleeve inserted with an end section into the hub and forms an outer axial supply space and an inner supply space which is separate from the former, wherein the outer axial supply space is connected in flow terms to the first supply ducts and the inner axial supply space is connected in flow terms to the second supply ducts. On the outer shell, the separating sleeve includes a number of axial grooves at least partially forming the outer axial supply space connected to the first supply ducts. The separating sleeve includes a number of radial apertures which connect the inner supply space to a second supply line.

12 Claims, 6 Drawing Sheets

(56) References Cited

U.S. PATENT DOCUMENTS

| | | | | |
|---|---|---|---|---|
| 6,601,554 | B1 | 8/2003 | Schaefer et al. | |
| 7,469,670 | B2 | 12/2008 | Rommel et al. | |
| 8,397,687 | B2 * | 3/2013 | Lichti ..... | F01L 1/3442 123/90.15 |
| 2012/0097122 | A1 | 4/2012 | Lichti | |

FOREIGN PATENT DOCUMENTS

| | | |
|---|---|---|
| DE | 10 2008 032412 | 1/2010 |
| DE | 10 2008 058110 | 5/2010 |
| DE | 10 2009 022868 | 12/2010 |

* cited by examiner

CAMSHAFT ADJUSTER AND SEPARATING SLEEVE FOR A CAMSHAFT ADJUSTER

The present invention relates to a camshaft adjuster, which includes a stator, a rotor which is rotatable relative to the stator around a rotation axis and has a hub for accommodating a camshaft, first supply channels and second supply channels, separated therefrom, essentially radially penetrating the hub, and a separating sleeve, inserted into the hub with at least one end section, which forms an outer axial supply space and an inner axial supply space, separated therefrom, in the hub, the outer axial supply space being fluidically connected to the first supply channels, and the inner axial supply space being fluidically connected to the second supply channels. The present invention also relates to a separating sleeve for insertion into the hub of a camshaft adjuster of this type, including an essentially hollow cylindrical base body.

BACKGROUND

Camshaft adjusters are industrial modules for adjusting the phase angle between a crankshaft and a camshaft in an internal combustion engine.

A camshaft adjuster of the type mentioned at the outset is also known from DE 10 2008 011 116 A1. The separating sleeve inserted into the hub separates the supply paths for hydraulic fluid for the first and second supply channels through the camshaft by forming at least one first and one second axial supply space. The supply spaces are supplied with hydraulic fluid via radial bores situated outside the rotor in the camshaft. For this purpose, a rotary transmitter is provided, which switchably allows the hydraulic fluid to flow in and out of the radial bores of the rotating camshaft with the aid of annular chambers. The separated axial supply spaces of the separating sleeve couple the supply channels of the rotor through the camshaft to the external hydraulic fluid supply. The first and second supply channels of the rotor are connected to the particular pressure chambers of the camshaft adjuster. For example, a retard of the rotor with respect to the stator, and thus the camshaft with respect to the crankshaft, takes place by applying pressure to the first supply channels, and an advance takes place by applying pressure to the second supply channels.

The separating sleeve according to DE 10 2008 011 116 A1 has a double-walled design for the purpose of forming the separated axial supply spaces. The receiving bores in the camshaft and in the hub of the rotor are each designed as complex stepped bores, which require complex manufacturing. The axial supply spaces designed as annular chambers and the corresponding recesses needed for coupling in the rotor result in a relatively large dead volume, which must be flowed through during activation of the pressure chambers.

SUMMARY OF THE INVENTION

It is an object of the present invention to provide a camshaft adjuster of the type mentioned at the outset, which is further improved with regard to the separating sleeve, in particular with regard to the manufacturing costs and the dead volume of hydraulic fluid to be switched. An object of the present invention is furthermore to provide a correspondingly suitable separating sleeve.

The present invention provides a camshaft adjuster of the type mentioned at the outset, in that the separating sleeve inserted into the hub includes a number of axial grooves on the outer shell which at least partially form the outer axial supply space and which are each fluidically connected to the first supply channels, and that the separating sleeve includes a number of radial apertures, which fluidically connect the inner supply space to a second supply line.

The present invention is based on the consideration that, by providing axial grooves which at least partially form the first axial supply space with respect to the hub and with respect to the receiving bore of the camshaft, the dead volume of the hydraulic fluid to be switched in the outer supply space may be reduced. By providing radial apertures, the inner supply space is directly coupled with the second supply channels of the hub. In other words, neither the first nor the second supply space projects into the hub as an annular chamber to be fluidically coupled therein to the supply channels. An axial minimum distance on the inserted end section between the annular chambers to be separated may thus be eliminated. The separation of the axial supply spaces may take place, in particular, via a distance in the circumferential direction. The present invention thus makes it possible to shorten the axial overall length of the rotor, so that more installation space is available in the camshaft adjuster for other mechanical elements, e.g., for a restoring spring. The volume of the hydraulic fluid to be switched is also, as a whole, reduced. The complex and cost-intensive manufacture of a complex inner geometry of the hub and the camshaft is also eliminated. In particular, a multi-stepped inner bore for accommodating the separating sleeve may be eliminated.

The radial apertures are advantageously each situated between the axial grooves in the circumferential direction. This permits a variable arrangement of the mouths of the first and second supply channels in the hub. The fluidic separation between the inner and outer axial supply spaces takes place exclusively via the spacing of the apertures from the axial grooves in the circumferential direction. The width of the wall between one aperture and one axial groove in the circumferential direction is preferably selected to be greater than half the width of the groove.

In one refinement of the present invention, the axial grooves each extend to one groove end, the groove ends and the radial apertures being essentially situated in an axial plane on the end section of the separating sleeve inserted into the hub. Due to this design, it is possible to situate the mouths of the radial supply channels inside the hub, also essentially in an axial plane. The first supply channels empty into the groove ends. The second supply channels empty into the radial apertures. In other words, the axial installation space of the rotor or the hub may be reduced in this manner without requiring a complex design of the inner geometry. A circumferential, axial edge, which rests against the base of the receiving chamber in the hub, is preferably provided on the end section of the separating sleeve for the purpose of sufficiently separating the inner supply space from the outer supply space. A sealing element is preferably situated at this point, in particular a sealing washer or the like.

The axial grooves on the end of the separating sleeve facing away from the end section furthermore preferably empty into a common annular groove. This facilitates an easy coupling of the hydraulic fluid outside the rotor, for example via a radial groove in the camshaft. A uniform supply of the axial grooves with the hydraulic fluid is also ensured via the annular groove.

In one additional advantageous embodiment, the separating sleeve is inserted, angle-oriented, into the hub with the aid of complementary form-fitting elements. This facilitates error-free assembly. The separating sleeve may be inserted into the hub only with the correct angle orientation. With this orientation, the grooves communicate with the first supply channels, and the apertures communicate with the second supply channels in the hub, or the mouths of these supply channels rest on the axial grooves or on the apertures. The separating sleeve advantageously has, for example, a tab on its end section, which engages with a corresponding groove in the hub of the rotor.

The separating sleeve is advantageously furthermore designed is such a way that the outer axial supply space is fluidically connected to a first radial bore of the camshaft, and the inner supply space is fluidically connected to a second radial bore of the camshaft in the case of a camshaft accommodated in the hub. For this purpose, the separating sleeve has, in particular, a suitable axial length, so that the axial grooves couple with a radial bore of the camshaft on the other end with respect to the end section inserted into the hub. In particular, the inner supply space of the separating sleeve is continued beyond the end of the separating sleeve, via the receiving bore of the camshaft, where it is coupled with the second radial bore. The inner supply space is formed, in particular, against a central screw, which axially penetrates the receiving bore of the camshaft in the assembled state and is screwed to the camshaft on the end of the receiving bore.

The separating sleeve is therefore preferably designed in such a way that, when the camshaft is accommodated, the axial grooves of the outer axial supply space are fluidically connected to the first radial bore of the camshaft via the common annular groove, and the inner axial supply space is fluidically connected to the second radial bore via a receiving bore in the camshaft.

According to the present invention, the second object mentioned is achieved for a separating sleeve of the type mentioned at the outset, in that the base body includes a number of axial grooves and also a number of radial apertures on its outer shell.

The axial grooves preferably each extend to one groove end, the groove ends and the radial apertures being essentially situated in an axial plane on an end section of the base body.

In one refinement, the axial grooves empty into a common annular groove on one end of the base body.

The advantages stated for the camshaft adjuster may be applied analogously to the refinements of the separating sleeve.

BRIEF DESCRIPTION OF THE DRAWINGS

Exemplary embodiments of the present invention are explained in greater detail below on the basis of a drawing.

DETAILED DESCRIPTION

Figure 1:
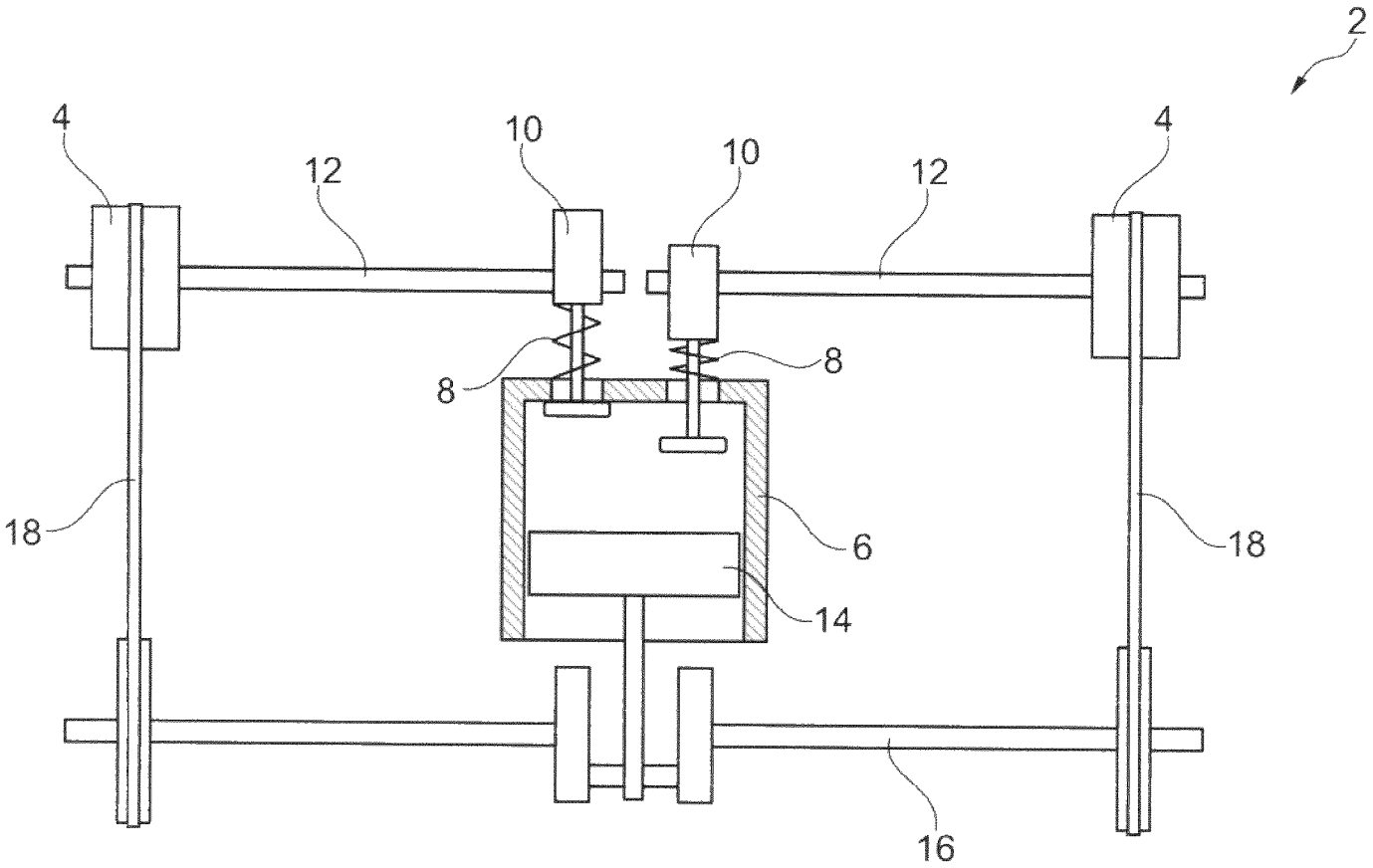
FIG. 1 shows a schematic representation of an internal combustion engine, including camshaft adjusters.

Reference is hereby made to FIG. 1, which shows a schematic representation of an internal combustion engine 2, including camshaft adjusters 4.

In a manner which is known per se, internal combustion engine 2 includes a combustion chamber 6, which may be opened and closed with the aid of valves 8. The valves are activated by cams 10 on corresponding camshafts 12. A reciprocating piston 14, which drives a crankshaft 16, is furthermore accommodated in combustion chamber 6. The rotation of crankshaft 16 is transmitted on its axial end to camshaft adjusters 4 via driving means 18. In the present example, the driving means may be a chain or a belt.

Camshaft adjusters 4 are each mounted axially on one of camshafts 12, are driven by driving means 18 and, in turn, drive camshafts 12. Camshaft adjusters 4 may change the phase angle of camshafts 12 with respect to crankshaft 16.

Figure 2:
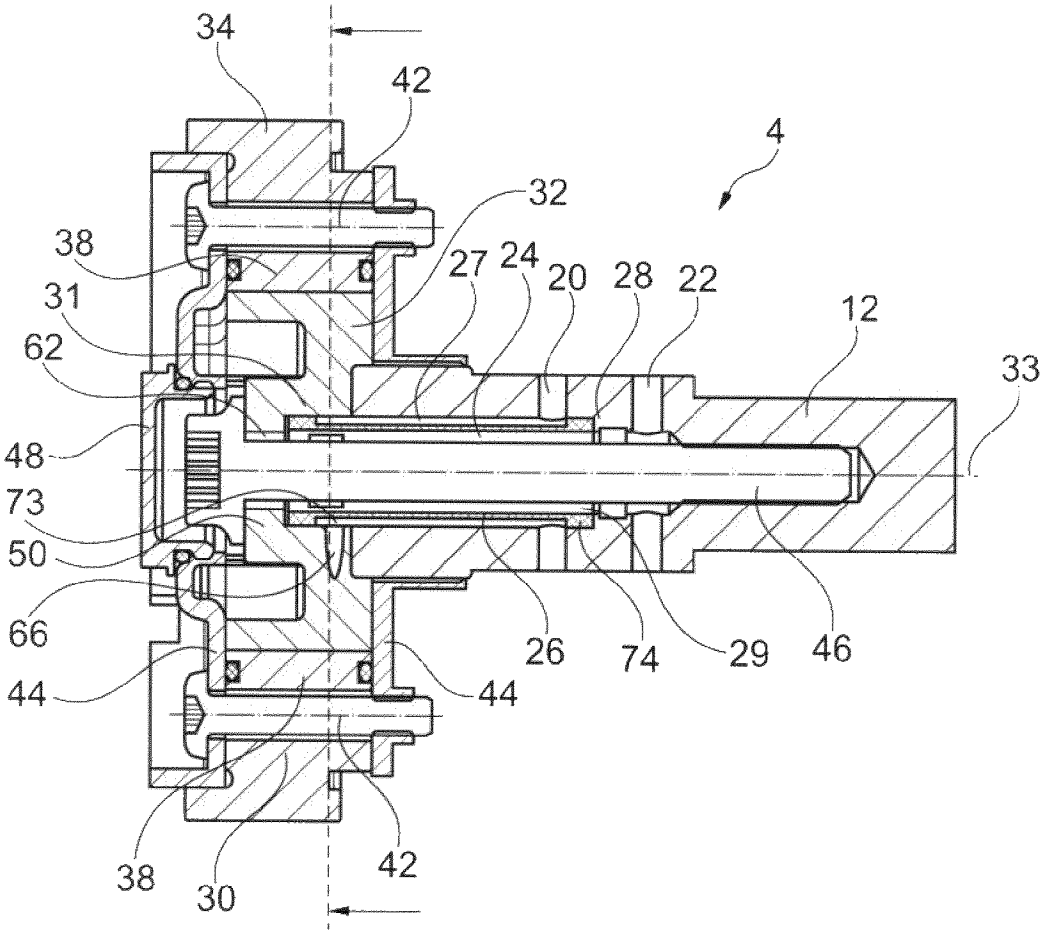
FIG. 2 shows a radial sectional view of one camshaft adjuster from FIG. 1.
Figure 3:
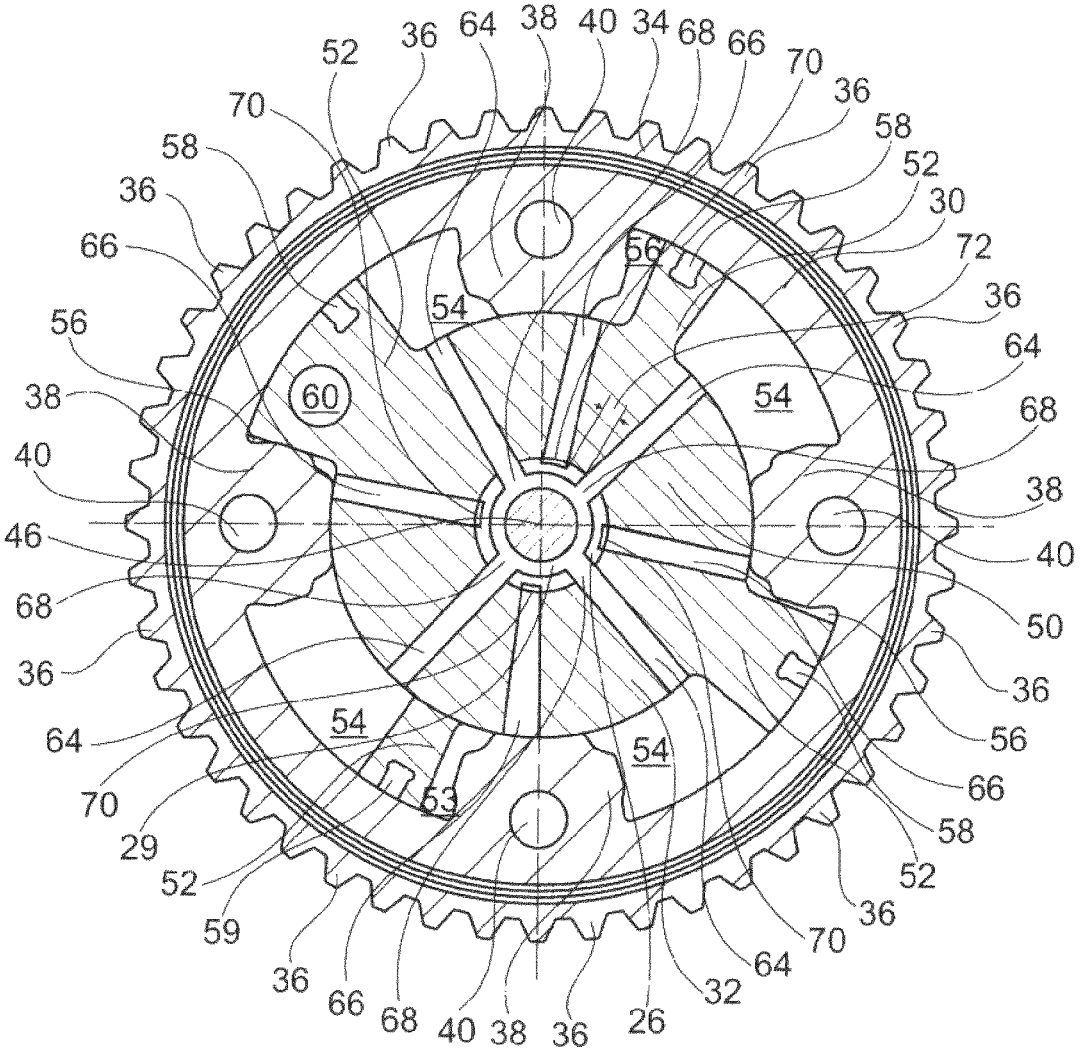
FIG. 3 shows an axial sectional view of one camshaft adjuster from FIG. 1.

Reference is hereby made to FIGS. 2 and 3, which show a radial and an axial sectional view of an example of one of camshaft adjusters 4 from FIG. 1.

Camshaft adjuster 4 is mounted on camshaft 12, which, in the present embodiment, has a first radial bore 20 and a second radial bore 22. The two radial bores 20, 22 may be connected to a pressure connection, which is not illustrated, and to a tank connection of an oil supply, which is not illustrated, via a particular annular groove, for example with the aid of a 4/3-way valve and a rotary transmitter.

A receiving bore 24, into which a separating sleeve 26 is inserted, is provided axially in camshaft 12. A step 28 of receiving bore 24 is provided between first radial bore 20 and second radial bore 22, separating sleeve 26 abutting one end of this step 28. Hydraulic fluid is supplied to or removed from an outer axial supply space 27, which is essentially formed by axial grooves 70 (e.g., see FIG. 5) of separating sleeve 26, via first radial bore 20, while, via second radial bore 22, hydraulic fluid is internally conducted to or discharged from an inner axial supply chamber 29 via receiving bore 24.

Separating sleeve 26 projects with an end section 31 out of receiving bore 24 of camshaft 12. Camshaft adjuster 4 is axially mounted on separating sleeve 26 and camshaft 12. Camshaft adjuster 4 has a stator 30 and a rotor 32, which is rotatably accommodated in stator 30. Rotation axis 33 of rotor 32 is indicated. Stator 30 has an outer ring 34, on which teeth 36 are provided, with which driving means 18 may engage for the purpose of rotatably fixedly connecting stator 30 to crankshaft 16. Separating elements 38, in which through-bores 40 are provided, which guide fixing screws 42, project from outer ring 34 radially to the inside. Fixing screws 42 axially fix covers 44 upstream and downstream from stator 30, whereby the inner chamber in outer ring 34 of stator 30 is closed. Covers 44 each have a through-opening in a central location, through which the camshaft is guided in the case of a camshaft-side cover 44, and through which a central screw 46, which is described below, may be guided in the case of cover 44 facing away from the camshaft. The through-opening of cover 44 facing away from the camshaft is closed by a cover disk 48.

Rotor 32 is rotatably fixedly connected to camshaft 12 via central screw 46. Central screw 46 penetrates receiving bore 24 of camshaft 12. Inner axial supply space 29 is thus designed as an annular chamber between separating sleeve 26 and central screw 46. Rotor 32 has a hub 50, in which camshaft 12 and end section 31 of separating sleeve 26 are accommodated. Radial vanes 52 project from hub 50 and end between separating elements 38 on stator 30. In this way, pressure chambers 54, 56 are provided, which are delimited by hub 50 of rotor 32 and outer ring 34 of stator 30 and, in the circumferential direction of camshaft adjuster 4, by a separating element 38 on stator 30 and a vane 52 on rotor 32. In a direction of rotation of camshaft adjuster 4 which is not illustrated, pressure chambers 54, 56 upstream from a vane 52 of rotor 32 are referred to as advance chambers, while downstream from a vane 52 of rotor 32, they are referred to as retard chambers.

Vanes 52 of rotor 32 have sealing elements 58 on their radial ends, which seal pressure chambers 54, 56 against each other. In a first vane 52 of rotor 32, a holding bore 60 is provided, in which a locking pin, which is not illustrated, may be resettably supported. The locking pin may lock a fixed position of rotor 32 with respect to stator 30, for the purpose, for example, of initially building up a certain operating pressure with the hydraulic fluid in camshaft adjuster 4 when internal combustion engine 2 starts up. A central bore 62 is provided in the center of rotor 32, through which central screw 46 is guided. Vane 52, including holding bore 60, has an enlarged design. To avoid an imbalance of camshaft adjuster 4, opposite vane 52 also has an enlarged design. Hub 50 is penetrated by fluidically separated, radial supply channels 64, 66 from central bore 62 into particular pressure chambers 54, 56. First supply channels 66 lead into pressure chambers 56, while second supply channels 64 lead into pressure chambers 54.

First supply channels 66 each empty into axial grooves 70 (see FIG. 5) of separating sleeve 26 and thus into outer axial supply space 27. In contrast, second supply channels 64 empty into radial apertures 68 of separating sleeve 26, which lead to inner axial supply space 29.

In the present embodiment, first and second supply bores 64, 66 empty into the same axial plane of camshaft adjuster 4. For the sake of clarity, only one of distances 72 between supply bores 64, 66 is provided with a reference numeral in FIG. 3. Axial grooves 70 thus extend to a groove end 73 on end section 31 of separating sleeve 26. Radial apertures 68 of separating sleeve 26 are each introduced between axial grooves 70. Apertures 68 and groove ends 73 are essentially situated in an axial plane.

Since supply channels 64, 66 essentially empty into an axial plane, the rotor may be designed to have a small axial width. The separation of inner supply space 29 and outer supply space 27 takes place via the spacing of groove ends 73 to radial apertures 68. Wall width 72 therebetween is approximately half of the groove width. Groove ends 73 and apertures 68 are spaced a distance from receiving base of hub 50 by a circumferential axial wall on end section 31 of separating sleeve 26. A sealing element, which is not indicated in further detail, is furthermore inserted therein, which is penetrated by central screw 46.

Figure 4:
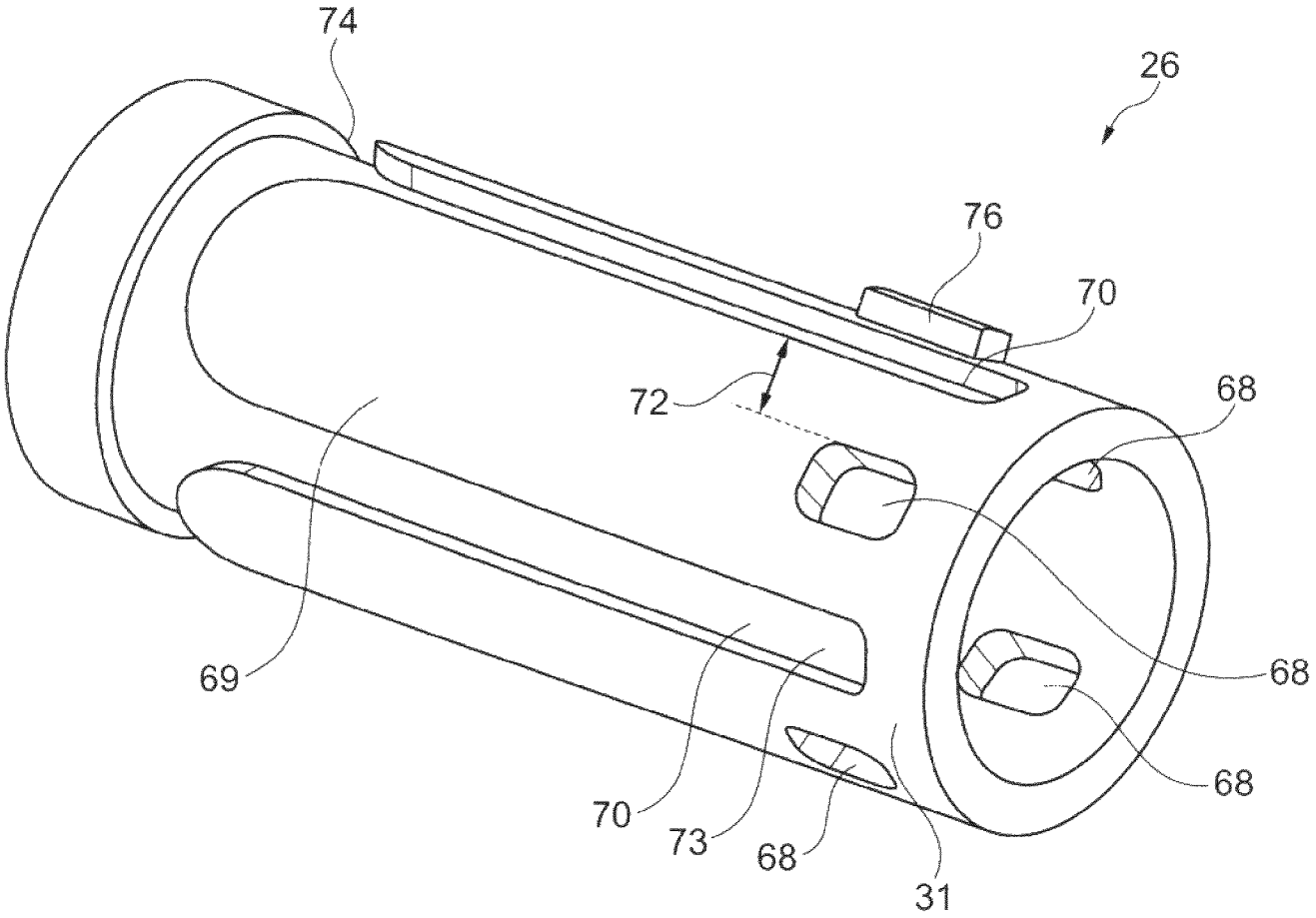
FIG. 4 shows a perspective view of a separating sleeve from FIGS. 2 and 3.
Figure 5:
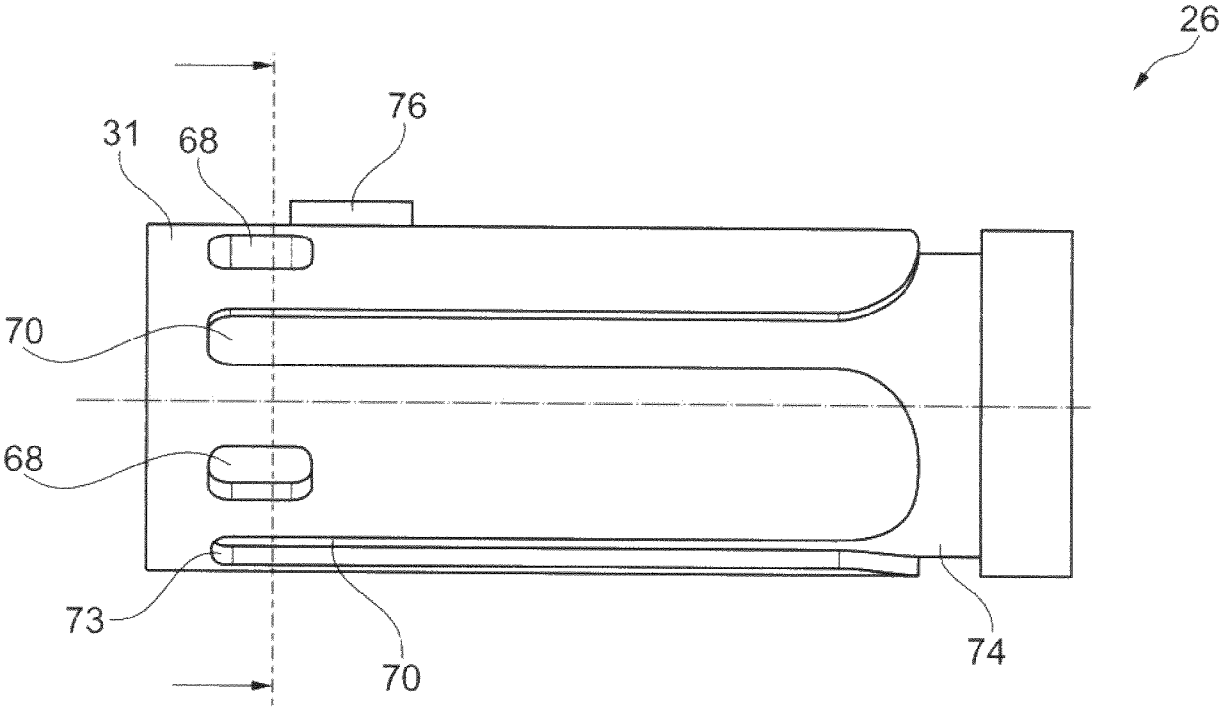
FIG. 5 shows a side view of the separating sleeve from FIG. 4.
Figure 6:
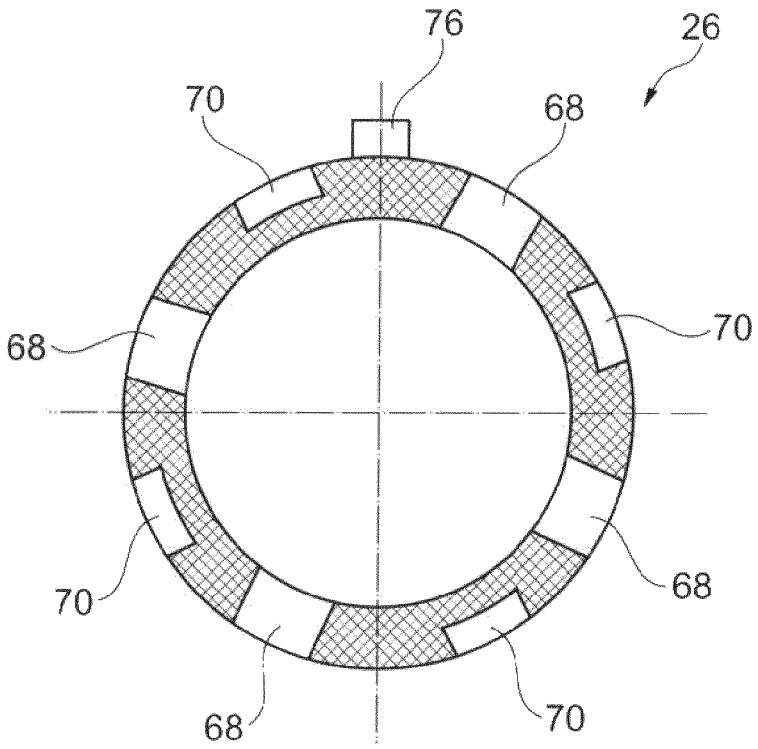
FIG. 6 shows an axial sectional view of the separating sleeve from FIG. 5.

Reference is hereby made to FIGS. 4 through 6, which show a perspective view, a side view and an axial sectional view of separating sleeve 26.

Separating sleeve 26 essentially includes a hollow cylindrical base body 69. A number of axial grooves 70 are introduced into the lateral surface of base body 69. They each end in a groove end 73 on end section 31 of separating sleeve 26 to be introduced into hub 50. Radial apertures 68 are introduced therein between groove ends 73 in a common axial plane. Axial grooves 70 empty into a common annular groove 74 on the other end of base body 69. This annular groove 74 is fluidically coupled with first radial bore 20 of camshaft 12 in the assembled state (see FIG. 2). However, this is illustrated only as an example. Axial grooves 70 may also be provided as a single groove in the circumferential direction of separating sleeve 26. It must only be ensured that hydraulic fluid flowing on the surface of separating sleeve 26 does not enter apertures 68.

Wall width 72 between through-openings 68 and groove ends 73 is correspondingly provided by approximately half the width of the groove.

As is directly apparent from FIG. 3, separating sleeve 26 will be inserted into central bore 62 of rotor 32 at a certain angle orientation. To ensure this angular position during installation without requiring adjustment effort, a tab 76 is provided on separating sleeve 26, which is insertable into an axial groove, which is not illustrated, on rotor 32.

LIST OF REFERENCE NUMERALS

2 Internal combustion engine
4 Camshaft adjuster
6 Combustion chamber
8 Valve
10 Cam
12 Camshaft
14 Reciprocating piston
16 Crankshaft
18 Driving means
20 First radial bore
22 Second radial bore
24 Receiving bore
26 Separating sleeve
27 Outer axial supply space
28 Step
29 Inner axial supply space
30 Stator
31 End section
32 Rotor
33 Rotation axis
34 Outer ring
36 Tooth
38 Separating element
40 Through-bore
42 Fixing screw
44 Cover
46 Central screw
48 Cover disk
50 Hub
52 Vane
54 Pressure chamber
56 Pressure chamber
58 Sealing element
60 Holding bore
62 Central bore
64 Second supply channel
66 First supply channel
68 Aperture
69 Base body
70 Axial groove
72 Wall width
73 Groove end
74 Annular groove
76 Tab

What is claimed is:

1. A camshaft adjuster comprising:

a stator, a rotor rotatable relative to the stator around a rotation axis and having a hub for accommodating a camshaft, first supply channels and second supply channels, separated therefrom, radially penetrating the hub, and a separating sleeve, inserted into the hub with at least one end section, which forms an outer axial supply space and an inner axial supply space, separated therefrom, in the hub, the outer axial supply space being fluidically connected to the first supply channels in an axial plane, and the inner axial supply space being fluidically connected to the second supply channels in the axial plane, the separating sleeve including a cylindrical base body including an outer shell defining an outer circumferential surface of the separating sleeve and a number of axial grooves penetrating partially radially into the cylindrical base body away from the outer shell, the axial grooves at least partially forming the outer axial supply space and which are each fluidically connected to the first supply channels, and that the separating sleeve includes a number of radial apertures fluidically connecting the inner axial supply space to a second supply line.

2. The camshaft adjuster as recited in claim 1 wherein the radial apertures are each situated between the axial grooves in the circumferential direction.

3. The camshaft adjuster as recited in claim 1 wherein the axial grooves each extend to one groove end, and the groove ends and the radial apertures are situated in an axial plane on the end section of the separating sleeve inserted into the hub.

4. The camshaft adjuster as recited in claim 1 wherein the axial grooves empty into a common annular groove on the end of the separating sleeve facing away from the end section.

5. The camshaft adjuster as recited in claim 1 wherein the separating sleeve is angle-oriented, in the hub with the aid of complementary tabs.

6. The camshaft adjuster as recited in claim 1 wherein the axial grooves extend between a first axial end and a second axial end of the outer supply space such the axial grooves are configured to fluidically connect to bores radially outside of the first axial end and to fluidically connect to the first supply channels at the second axial end.

7. The camshaft adjuster as recited in claim 1 wherein the radial apertures are circumferentially aligned with the second axial end in the axial plane.

8. The camshaft adjuster as recited in claim 1 wherein the radial apertures feed directly into the second supply line.

9. The camshaft adjuster as recited in claim 1 wherein the separating sleeve includes a first end received in the hub and a second end protruding outside of the hub, the first end of the separating sleeve including a radially extending cylindrical wall axially abutting a portion of the hub.

10. The camshaft adjuster as recited in claim 9 further comprising a central screw received inside of the separating sleeve axially abutting the portion of the hub from an opposite side as the separating sleeve.

11. The camshaft adjuster as recited in claim 1 wherein the separating sleeve includes a first end received in the hub and a second end protruding outside of the hub, the outer axial supply space including an annular groove at the second end and axial grooves extending from the annular groove to the first supply channels.

12. A camshaft adjuster comprising:

a stator, a rotor rotatable relative to the stator around a rotation axis and having a hub for accommodating a camshaft, first supply channels and second supply channels, separated therefrom, radially penetrating the hub, and a separating sleeve, inserted into the hub with at least one end section, which forms an outer axial supply space and an inner axial supply space, separated therefrom, in the hub, the outer axial supply space being fluidically connected to the first supply channels, and the inner axial supply space being fluidically connected to the second supply channels, the separating sleeve including a cylindrical base body including an outer shell defining an outer circumferential surface of the separating sleeve and a number of axial grooves penetrating partially radially into the cylindrical base body away from the outer shell, the axial grooves at least partially forming the outer axial supply space and which are each fluidically connected to the first supply channels, and that the separating sleeve includes a number of radial apertures fluidically connecting the inner axial supply space to a second supply line, the separating sleeve including a first end received in the hub and a second end protruding outside of the hub, the outer axial supply space including an annular groove at the second end and the axial grooves extending from the annular groove to the first supply channels.

* * * * *